US005465435A

United States Patent [19]

Malvaez et al.

[11] Patent Number: 5,465,435

[45] Date of Patent: Nov. 14, 1995

[54] SHOWER STEP FOR SHAVING LEGS

[76] Inventors: Laura A. Malvaez, 25200 Calros Bee Blvd. No. 89, Hayward, Calif. 94542; David J. Monfredini, 407 Vicente St., San Francisco, Calif. 94116

[21] Appl. No.: 391,782

[22] Filed: Feb. 21, 1995

[51] Int. Cl.[6] ..... A47K 3/024

[52] U.S. Cl. ..... 4/574.1; 248/297.31

[58] Field of Search ..... 4/574.1, 576.1, 4/611; 248/295.1, 297.3

[56] References Cited

U.S. PATENT DOCUMENTS

| | | | |
|---|---|---|---|
| D. 170,853 | 8/1953 | Dunham | D4/574 X |
| D. 190,624 | 6/1961 | Morrison et al. | D4/4 |
| D. 340,508 | 10/1993 | Hocker | D23/304 |
| 2,456,174 | 12/1948 | Clark | 4/574.1 |
| 2,818,577 | 7/1956 | Kubik et al. | 4/146 |
| 3,275,283 | 9/1966 | Rauch | 248/217 |
| 4,489,448 | 12/1984 | Cairo | 4/574 |
| 4,717,105 | 1/1988 | Stefani | 248/295.1 |
| 4,994,648 | 8/1989 | Gil | 219/217 |
| 5,228,151 | 7/1993 | Livingston-Capoano | 4/574.1 |
| 5,340,070 | 8/1994 | Soma | 4/574.1 X |
| 5,341,528 | 8/1994 | Sultzbaugh | 4/574.1 X |

FOREIGN PATENT DOCUMENTS

| | | | |
|---|---|---|---|
| 2405599 | 8/1975 | Germany | 4/574.1 |

*Primary Examiner*—Charles E. Phillips

[57] ABSTRACT

A wall-mounted foot support for use primarily in a shower stall enclosure during showering, whereon a woman can rest or support her foot to elevate her leg while shaving the elevated leg. The support is height-adjustable so as to accommodate users of various heights, so that the user will be made more comfortable when shaving a leg. The foot support eliminates the risk of injury in the shower due to bending, slipping, odd body contortions, and razor slippage.

8 Claims, 2 Drawing Sheets

SHOWER STEP FOR SHAVING LEGS

BACKGROUND OF THE INVENTION

1. Field

The invention is in the field of foot supporting devices for use in both a tub or shower enclosure and, more particularly, to a foot-supporting device that my be used when washing, drying, or treating the feet and legs during or after showering.

2. State of the Art

Generally speaking, shower stalls do not provide any horizontal surface areas which can be used as a foot support for shaving one's legs. Most women must either bend down, sit on the floor of the shower, or raise the leg and rest the foot against a wall surface. These positions are uncomfortable and my contribute to accidents such as falls or cuts while shaving.

Prior art patents address the needs of foot washing, but not of the needs of leg shaving. U.S. Pat. No. 2,818,577 describes a foot support for shower baths consisting of a foot support platform mounted on a long pole which then leans diagonally against two walls for support. U.S. Pat. No. 4,489,448 provides for a free-standing stool-like footrest with two overlapping foot/toe shaped impressions on the platform whereby either left or right foot can be supported by one of the overlapping footprint indentations. U.S. Pat. No. 170,853 is a design patent for a free-standing shower footrest. U.S. Pat. No. 3,275,283 is a wall-mounted folding footrest and seat combination which retracts into the wall when not in use.

BRIEF SUMMARY OF THE INVENTION

In all cases, the aforementioned prior art's purposes are solely for the washing and/or drying of one's feet, however the purpose of shaving one's legs has never been addressed. Since shower stalls have limited space, a stool-like foot rest is both cumbersome and impractical, therefore a smaller, wall-mounted, height-adjustable shower step would be the most desirable device to provide the necessary support and eliminate the need to bend down, sit on the shower stall floor, or raise the leg to dangerous positions while shaving, and would also elevate the leg so as to give better access to all parts of the leg being shaved.

The shower step of the present invention would be made of plastic, brass, procelein, or chrome to fit in with the shower motif. A bracket is mounted to the wall of the shower stall containing a sleeve allowing a square-shaped shaft to slide through the bracket. Along the shaft are three holes at one-inch intervals corresponding to three height settings, the holes being large enough to accommodate a pin going through both the bracket and the shaft.

The shaft will be topped with a foot rest plate set at an inclined angle of about 74°, so as to provide a comfortable inclined horizontal surface area on which to rest the foot while the leg is in a raised position.

For safety, the foot rest plate's edges are curved so as to avoid injury caused by accidentally bumping into the plate. The head of the foot plate is cut so as to resemble a semi-circle facing the user.

For convenience, the front face of the sleeve may contain an indentation large enough to allow as razor to be hung/stored on the shower step bracket itself.

The objects and features of the present invention will be readily apparent to those skilled in the art from the appended drawings and specification illustrating a preferred embodiment wherein:

DESCRIPTION OF THE PREFERRED EMBODIMENT

Figure 1:
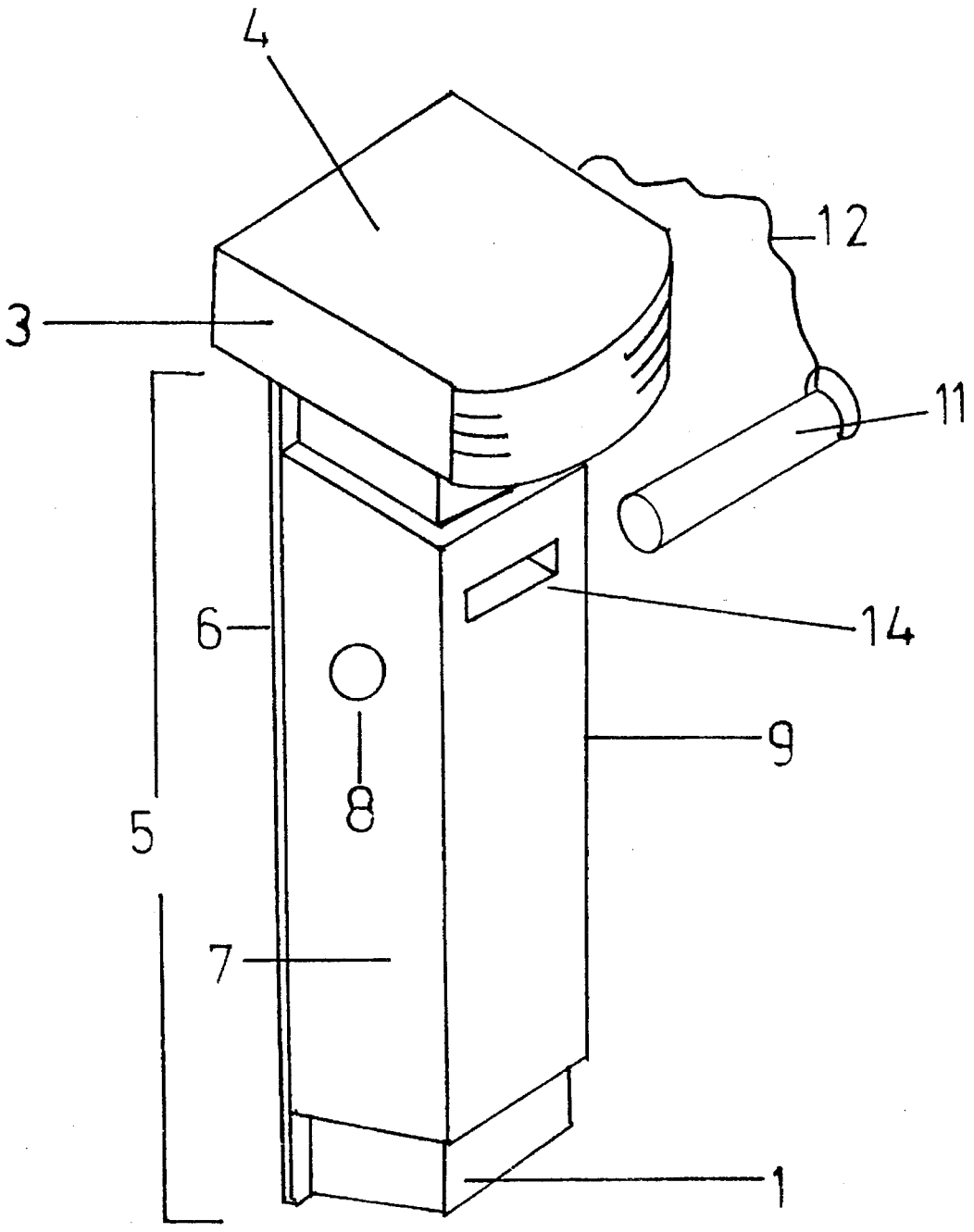
FIG. 1 is a perspective view of the shower step.
Figure 2:
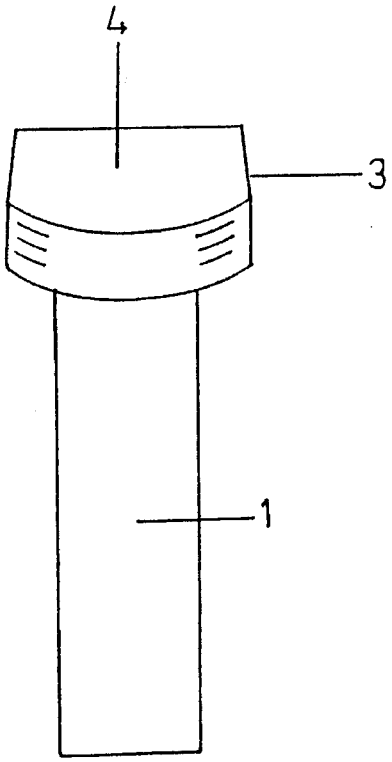
FIG. 2 is a front elevation view of the footrest shaft.
Figure 3:
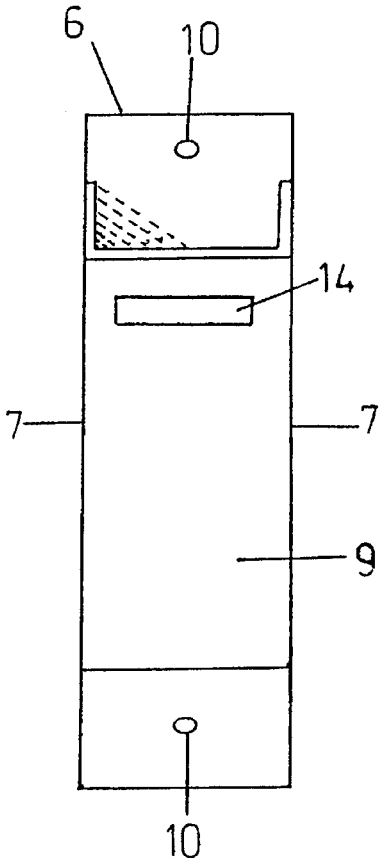
FIG. 3 is a front elevation view of the base/bracket.
Figure 4:
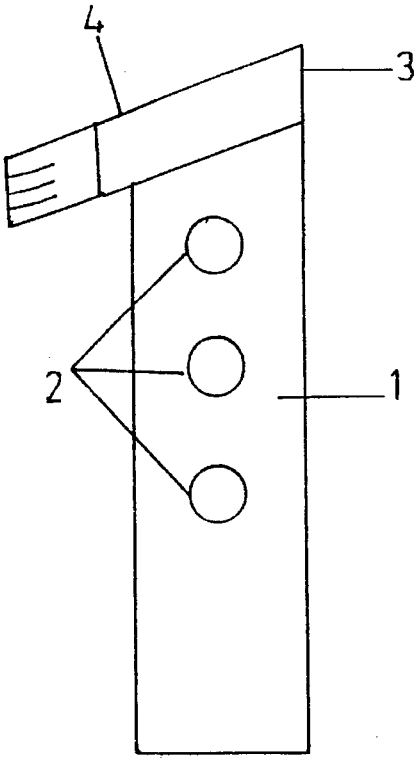
FIG. 4 is a side elevation view of the footrest shaft.
Figure 5:
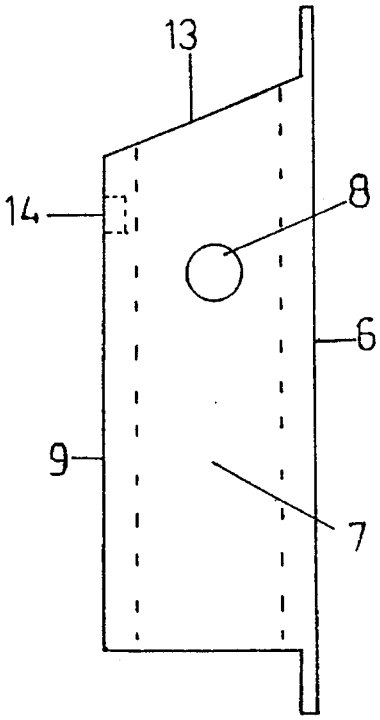
FIG. 5 is a side elevation view of the base/bracket.

The shower footrest displayed in the drawings is shown in FIG. 1 in its assembled form. The footrest includes a base/bracket as shown in FIG. 3 & 5, and footrest shaft as shown in FIG. 2 and 4. The footrest may be contructed of any suitable material which would be water-resistant, such as porcelein, plastic, rubber, and so forth. As shown in FIG. 4, the footrest includes shaft 1 containing three holes 2 through said shaft and a horizontally-inclined step plate 3. The step plate 3 is attached to the top of the shaft 1. The step plate 3 includes a head 4 covered with any suitable non-slip surface material so as to prevent the foot from slipping from the head while in use during a shower. As shown in FIG. 3, the base portion 5 that houses the shaft 1, includes a rear wall 6 having holes 10 at the topmost and bottommost edges of said rear wall 6 for the purpose of mounting the base portion 5 to a shower stall wall. The base portion 5 has two shorter side walls 7, each wall has a single hole 8 and the holes 8 in the walls are aligned. The side walls 7 are connected to a front wall 9 for the purpose of enclosing the base unit, thus creating a hollow space 13 through which the shaft 1 will move. The front wall 9 includes an indentation 14 adapted for storage such as housing a razor or other articles used while showering. As shown FIG. 1, a peg 11 is provided for holding the step plate 3 in an adjusted position within the base portion 5. Peg 11 passes through holes 8 in the base portion 5 and holes 2 in the step plate 3. As shown in FIG. 1, the peg 11 is attached to side wall 7 by a chain 12 of reasonable length so as to avoid the peg from becoming lost when not in use.

The base portion 5 and shaft 1 may be cast or molded as two separate pieces and are designed to fit together to be assembled as one unit.

The above described shower step is to be used while showering and leg shaving and is placed in the shower so that the user does not have to balance herself precariously while shaving her legs. The unique shape of the shower footrest makes it possible to place the footrest on any wall of the showering space without obstructing the user's legs or feet while in the shower.

Furthermore, the small size of the footrest makes it convenient for storage and shipping purposes as well as for attachment to the shower wall. The provision of a space 14 for a razor or other implement makes it unneccesary to search for the razor. Also, the inclined slant of the shower step head 4 avoids the possibility of accumulation of water on the head 4.

It is apparent that the example above has been given solely by way of illustration and not by way of limitation and that the embodiment illustrated is subject to many variations and modifications within the scope of the appended claims. All such variations and modifications are to be included within the scope of the present invention.

We claim:

1. A wall mountable shower step for use in raising a user's leg and foot above the floor level of a shower stall for the purpose of positioning the leg and foot of a user in a more accessible position for washing or shaving, said shower step comprising:

A) a base portion adapted to be mounted to a vertical wall of a shower stall, a) said base portion having a rear wall, two side walls and a front wall, said rear, side walls and front wall being joined to provide an interior hollow space between said walls, b) said rear wall being provided with cutout portions defining mounting holes for cooperation with means for mounting said base portion to said vertical wall of said shower stall, c) each of said side walls having a cutout portion defining a support hole, said support holes in said side walls being horizontally aligned, d) and a locking means adapted to pass through said support holes, B) a movable footrest member, a) said footrest member including a shaft having a vertical axis and a step plate, b) said shaft being dimensioned to slideably fit within said interior hollow space in said base portion, c) a plurality of cutout portions through said shaft defining adjustment holes, said adjustment holes being axially disposed along said shaft and being respectively horizontally alignable with said support holes in said base portion so as to adjustably position said shaft within said base portion, d) said step plate being attached to said shaft and including a step plate head aligned at a downwardly inclined angle with respect to the vertical axis of said shaft, C) said base portion and footrest member being adapted to be assembled with said shaft slidable through said interior hollow space of said base and to be fixed in an adjusted position by cooperation of said locking means passing through said support holes in said side walls and one of said adjustment holes in said shaft, D) whereby a user of said shower step may elevate a leg and foot by placing a foot on said step plate while standing within said shower stall.

2. The wall mountable shower step of claim 1 wherein said shaft of said footrest member has three vertically aligned support holes.

3. The wall mountable shower step of claim 1 wherein said step plate in inclined at about 74 degrees with respect to the vertical axis of said shaft.

4. The wall mountable shower step of claim 1 wherein said step plate is covered with a non-slip surface.

5. The wall mountable shower step of claim 1 wherein the dimensions of said shaft of said foot rest are selected to permit said shaft to slide within said interior space between said walls of said base portion and to align said adjustment holes in said shaft with said support holes in said side walls.

6. The wall mountable shower step of claim 1 wherein said front wall of said base portion is provided with an indentation for accommodating articles for use within said shower stall.

7. The wall mountable shower step of claim 1 wherein said locking means is a peg dimensionally sized to fit through said mounting holes and said support holes.

8. The wall mountable shower step of claim 7 wherein said peg is attached to said base portion by an elongated flexible connector.

* * * * *